US007994849B2

(12) United States Patent
Pan

(10) Patent No.: US 7,994,849 B2
(45) Date of Patent: Aug. 9, 2011

(54) DEVICES, SYSTEMS, AND METHODS FOR GENERATING A REFERENCE VOLTAGE

(75) Inventor: Dong Pan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 12/059,357

(22) Filed: Mar. 31, 2008

(65) Prior Publication Data

US 2009/0243709 A1 Oct. 1, 2009

Related U.S. Application Data

(63) Continuation of application No. 11/196,978, filed on Aug. 4, 2005, now Pat. No. 7,256,643.

(51) Int. Cl.
*G05F 1/10* (2006.01)
*G05F 3/02* (2006.01)

(52) U.S. Cl. ..... 327/539

(58) Field of Classification Search ..... 327/539, 327/512–513; 323/313, 315, 316
See application file for complete search history.

(56) References Cited

U.S. PATENT DOCUMENTS 5,352,973 A 10/1994 Audy
5,359,552 A 10/1994 Dhong et al.
5,410,195 A * 4/1995 Ichihara ..... 327/10
5,798,741 A * 8/1998 Kajihara ..... 345/94
5,835,420 A 11/1998 Lee et al.
5,933,045 A 8/1999 Audy et al.
6,009,022 A 12/1999 Lee et al.
6,172,555 B1 * 1/2001 Gusinov ..... 327/539
6,489,831 B1 12/2002 Matranga et al.
6,545,923 B2 4/2003 Sim et al.
6,563,371 B2 5/2003 Buckley, III et al.
6,710,642 B1 * 3/2004 Tang et al. ..... 327/539
6,714,462 B2 3/2004 Pan
6,765,431 B1 7/2004 Coady
6,809,986 B2 10/2004 Kim et al.
6,838,864 B2 1/2005 Di Iorio
6,847,560 B2 1/2005 Pan
6,933,769 B2 8/2005 Koelling
7,112,948 B2 9/2006 Daly et al.
7,113,025 B2 9/2006 Washburn
7,166,994 B2 1/2007 Lee et al.
7,170,274 B2 1/2007 Mukherjee et al.
7,170,336 B2 1/2007 Hsu
7,193,454 B1 3/2007 Marinca
7,256,643 B2 8/2007 Pan et al.
(Continued)

OTHER PUBLICATIONS

Phang et al., "Low Voltage, Low Power CMOS Bandgap References," University of Toronto (date unknown) pp. 1-17.
Waltari et al., "Reference Voltage Driver for Low-Voltage CMOS A/D Converters," IEEE (2000) pp. 28-31.

*Primary Examiner* — Quan Tra
(74) *Attorney, Agent, or Firm* — TraskBritt

(57) ABSTRACT

Methods, devices, and systems are disclosed for a voltage reference generator. A voltage reference generator may comprise a bandgap voltage reference circuit configured to output two complementary-to-absolute-temperature (CTAT) signals. The voltage reference generator may further comprise a differential sensing device configured to sense the two complementary-to-absolute-temperature (CTAT) signals and generate a positive reference signal substantially insensitive to temperature variations over an operating temperature range.

25 Claims, 8 Drawing Sheets

U.S. PATENT DOCUMENTS

2006/0001413 A1 1/2006 Marinca
2007/0030053 A1* 2/2007 Pan et al. ..... 327/539
2007/0052473 A1* 3/2007 McLeod ..... 327/539
2007/0159238 A1 7/2007 Pan et al.
2007/0290669 A1* 12/2007 Kurata et al. ..... 323/314
2008/0224761 A1* 9/2008 Deng et al. ..... 327/539

* cited by examiner

DEVICES, SYSTEMS, AND METHODS FOR GENERATING A REFERENCE VOLTAGE

CROSS-REFERENCE TO RELATED APPLICATIONS

This application is related to U.S. patent application Ser. No. 11/711,563, filed Feb. 27, 2007, now U.S. Pat. No. 7,489,184, issued Feb. 10, 2009, for DEVICE AND METHOD FOR GENERATING A LOW-VOLTAGE REFERENCE, which is a continuation of U.S. patent application Ser. No. 11/196,978, filed Aug. 4, 2005, now U.S. Pat. No. 7,256,643, issued Aug. 14, 2007, for DEVICE AND METHOD FOR GENERATING A LOW-VOLTAGE REFERENCE.

TECHNICAL FIELD

Embodiments of the present invention relate to devices, systems, and methods for generating a reference signal. More particularly, embodiments of the present invention relate to generating a low-voltage reference signal for integrated circuits such as memory devices.

BACKGROUND

Dynamic random access memory (DRAM) devices provide a large system memory and are relatively inexpensive because, in pan, as compared to other memory technologies, a typical single DRAM cell consists only of two components: an access transistor and a capacitor. As is well known in the art, the storage capability of the DRAM cell is transitory in nature because the charge stored on the capacitor leaks. The charge can leak, for example, across the plates of the capacitor or out of the capacitor through the access transistor. As a result, DRAM cells must be refreshed many times per second to preserve the stored data. With the refresh process being repeated many times per second, an appreciable quantity of power is consumed. In portable systems, obtaining the longest life out of the smallest possible battery is a crucial concern, and, therefore, reducing the need to refresh memory cells and, hence, reducing power consumption is highly desirable.

The refresh time of a memory cell is degraded by two major types of leakage current; junction leakage current caused by defects at the junction boundary of the transistor and channel leakage current caused by sub-threshold current flowing through the transistor. Leakage current can be reduced by increasing the magnitude of the gate-to-source voltage that is applied to turn OFF the access transistor and leaving the threshold voltage of the transistor the same. Thus, instead of applying zero volts on the word line to turn OFF an NMOS access transistor, a negative voltage of −0.3 volts may be applied to the word line, decreasing the transistor's current leakage for a given threshold voltage.

The application of a negative voltage to the word line must be precisely controlled or the channel of the pass gate which isolates the storage capacitor may be significantly stressed or even damaged. Therefore, a stable and accurate voltage reference has been conventionally employed for generating a negative voltage word line ($V_{NWL}$) signal. Desirably, precision voltage references should be insensitive to manufacturing (process) and environmental variations, voltage variations, and temperature variations (PVT variations).

One of the more popular voltage reference generators for generating a negative voltage reference signal for coupling to the inactive word lines includes a bandgap voltage reference. Typically, a bandgap voltage reference circuit uses the negative temperature coefficient of emitter-base voltage differential of two transistors operating at different current densities to make a zero temperature coefficient reference. Such an approach proved adequate until advances in sub-micron CMOS processes resulted in supply voltages being scaled-down with the present processes operating at sub 1 volt supply voltages. This trend presents a greater challenge in designing bandgap reference circuits which can operate at very low voltages. Even though conventional bandgap circuits can generate a PVT insensitive voltage, the minimum supply voltage Vcc required for proper operation at cold temperatures is approximately 1.05 V.

FIG. 1 illustrates a conventional circuit diagram of a voltage reference generator 10 including a bandgap voltage reference 12 configured to generate a signal $V_{BG1}$. The bandgap voltage reference 12 includes a divider network including a resistive (L*R) element 20 and a diode (1X) element 22 coupled to a first input of a differential amplifier 18. A second input of the differential amplifier 18 is coupled to a divider network including a resistive (L*R) element 24, resistive (R) element 26 and a diode array (8X) element 28. Signal $V_{BG1}$ couples to a differential amplifier 30 and generates a reference signal 32. In the conventional voltage reference generator 10, bandgap voltage reference 12 outputs signal $V_{BG1}$ with a potential of approximately 1.2 volts to 1.3 volts. Signal $V_{BG1}$ goes through differential amplifier 30 to generate reference signal 32 having a potential of approximately −0.3 volts. Signal $V_{BG1}$ must be set at about 1.3 volts to get the zero temperature coefficient as shown by:

$$(V_{BG1})=L*n*lnK*V_t+V_{d1}$$

where, L is the resistor ratio, n is the process constant (approx.=1), K is the BJT ratio, $V_t$ is the thermal voltage (about 25.6 mV at room temperature has a temperature coefficient of about 0.085 mV/C), and $V_{d1}$ is the voltage at the 1X diode (about 0.65 volts at 27° C. has temp. coefficient of about −2.2 mV/C).

In order to have a zero temperature coefficient, L*n*lnK*0.085 mV=2.2 mV, so the L*n*lnK must be about 2.2 mV/0.085 mV=25.8.

Thus, $V_{BG1}$=25.8*25.6 mV+0.65=1.31 volts.

Since signal $V_{BG1}$ is about 1.3 volts, the minimum power supply voltage for the bandgap voltage reference circuit shown in FIG. 1 must be higher than 1.3 volts, which is unacceptable for circuits that operate on a supply voltage Vcc of less than 1.2 volts.

FIG. 2 illustrates another conventional circuit diagram of a voltage reference generator 50 that includes a bandgap voltage reference 52, which is configured to generate a signal $V_{BG2}$. Bandgap voltage reference 52 includes a network including a resistive element 60 and a diode (1X) element 62 coupled to a first input of a differential amplifier 58. A second input of the differential amplifier 58 is coupled to a network including a resistive element 64 and a diode array (8X) element 66. Signal $V_{BG2}$ couples to a unity buffer 68 and a differential amplifier 70 and generates a reference signal 72. In the conventional voltage reference generator 50, the CTAT current flows through a PTAT resistor 74 to generate a zero temperature coefficient output signal $V_{BG2}$ of about 0.6 volts. The voltage reference generator is then buffered and connected to the differential amplifier 70 to generate a −0.3 volt reference voltage. One disadvantage of this approach occurs during cold temperature operation when the voltage on the diode (1X) element 62 at the cold temperature becomes higher (e.g., about 0.82 volts at −40° C.). Accordingly, additional voltage (e.g. 0.2 volts to 0.3 volts) is needed for the PMOS devices in the amplifiers to remain in the saturation region. Thus, the minimum power supply voltage for the bandgap voltage reference 52 shown in FIG. 2 must be higher than 0.82 volts+0.23 volts=1.05 volts. Although bandgap voltage reference 52 may output a lower potential for signal $V_{BG2}$ than the conventional bandgap voltage reference 12 of FIG. 1, the minimum acceptable supply voltage Vcc of the voltage reference generator 50 of FIG. 2 remains above 1.0 volt (e.g., 1.05 volts) which is unacceptable for circuits that desire to operate on a supply voltage Vcc of less than 1.0 volt.

There is a need for systems, devices, and methods for generating a low-voltage reference signal that remains relatively stable for a broader range of operating voltages including lower operating potentials.

DETAILED DESCRIPTION

In the following detailed description, reference is made to the accompanying drawings which form a part hereof and, in which is shown by way of illustration, specific embodiments in which the invention may be practiced. These embodiments are described in sufficient detail to enable those of ordinary skill in the art to practice the invention and it is to be understood that other embodiments may be utilized and that structural, logical, and electrical changes may be made within the scope of the disclosure.

In this description, functions may be shown in block diagram form in order not to obscure the present invention in unnecessary detail. Furthermore, specific implementations shown and described are only examples and should not be construed as the only way to implement the present invention unless specified otherwise herein. Block definitions and partitioning of logic between various blocks represent a specific implementation. It will be readily apparent to one of ordinary skill in the alt that the various embodiments of the present invention may be practiced by numerous other partitioning solutions. For the most part, details concerning timing considerations, and the like, have been omitted where such details are not necessary to obtain a complete understanding of the present invention in its various embodiments and are within the abilities of persons of ordinary skill in the relevant art.

Referring in general to the following description and accompanying drawings, various aspects of the present invention are illustrated to show its structure and method of operation. Common elements of the illustrated embodiments are designated with like numerals. It should be understood the figures presented are not meant to be illustrative of actual views of any particular portion of the actual structure or method, but are merely idealized representations which are employed to more clearly and fully depict the present invention.

A voltage reference generator may provide a stable reference signal to one or more electrical circuits in an electronic device. In one example of an electronic device, a memory device including a plurality of memory storage cells requires stable reference signals to minimize data corruption or "upset" due to leakage current. Similarly, voltage levels of the reference signals may be adjusted to provide improved performance in circuits subjected to reduced dynamic range of operational voltage levels. One or more embodiments of the present disclosure find application to memory devices and, in particular, to low-voltage DRAM devices.

Figure 3:
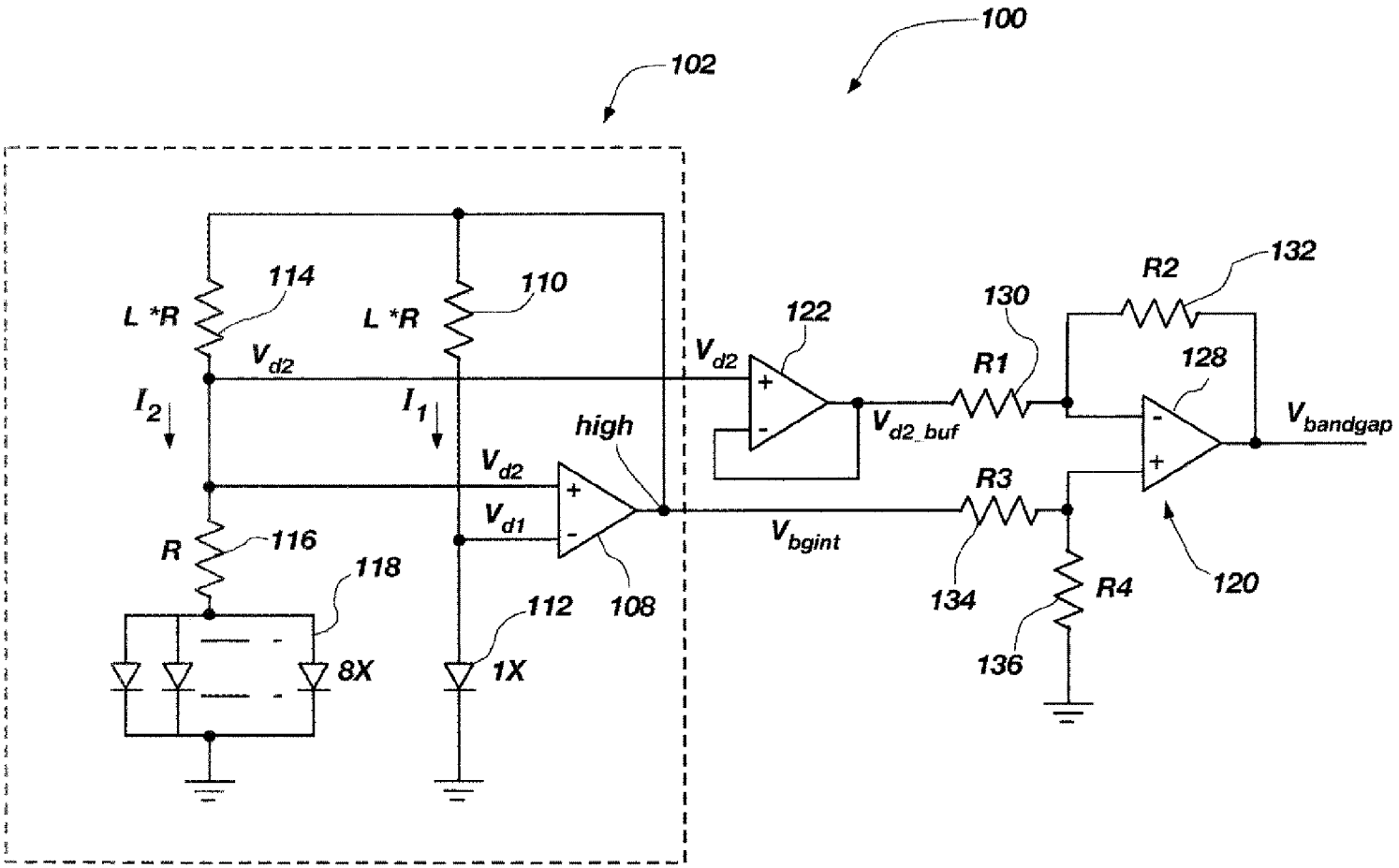
FIG. 3 is a circuit diagram of a voltage reference generator, in accordance with an embodiment of the present invention.

FIG. 3 is a circuit diagram of a voltage reference generator 100, in accordance with an embodiment of the present disclosure. Voltage reference generator 100 is configured to provide a positive reference voltage over a lesser operating voltage than conventional bandgap reference generators. Also, voltage reference generator 100 provides expanded tolerance for operational voltage variations due to variations in operational voltage sources and operational and implementation extremes resulting from device processing (P) variations, operational voltage (V) source variations, and operational temperature (T) variations, generally known as PVT corners, when graphically plotted.

Referring to FIG. 3, a voltage reference generator 100 includes a low-voltage bandgap voltage reference circuit 102 which is configured to generate a first complementary-to-absolute-temperature (CTAT) signal $V_{bgint}$ ad a second complementary-to-absolute-temperature (CTAT) signal $V_{d2}$. As known by one having ordinary skill in the art, a complementary-to-absolute-temperature (CTAT) signal may exhibit a decrease in voltage during an increase in operating temperature. Bandgap voltage reference circuit 102 includes a divider network including a resistive (L*R) element 110 and a diode (1X) element 112 operably coupled to non-inverting input of a differential amplifier 108. An inverting input of differential amplifier 108 is operably coupled to a divider network including a resistive (L*R) element 114, resistive (R) element 116 and a diode array (8X) element 118.

For calculation of the element values for the bandgap voltage reference circuit 102, $$V_{bgint}=L*n*lnK*V_1+V_{d2}$$

where, L is the resistor ratio, n is the process constant (approx.=1), K is the BJT ratio, $V_t$ is the thermal voltage (about 25.6 mV at room temperature and has a temperature coefficient (TC) of about 0.085 mV/C), and $V_{d2}$ is the voltage between resistive element 114 and resistive element 116 (about 0.65 volts at 27° C, has a temperature coefficient of about −2.2 mV/C).

Figure 1:
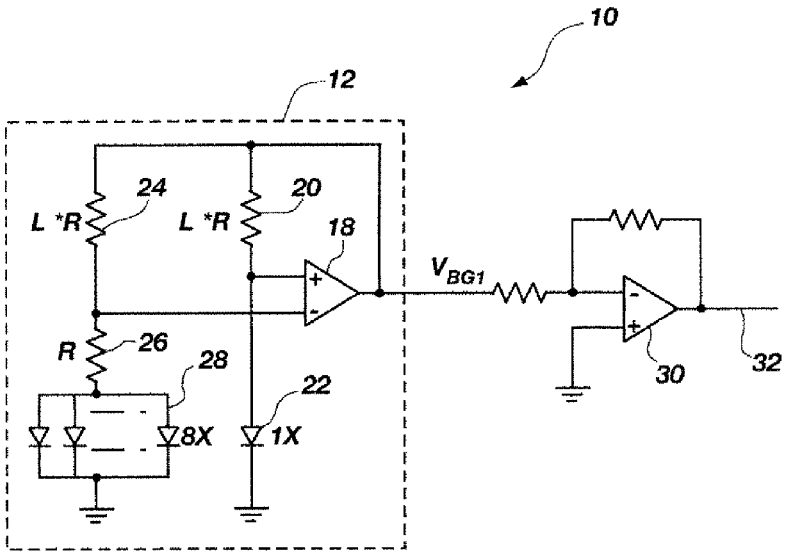
FIG. 1 (PRIOR ART)
FIG. 1 is a circuit diagram of a conventional voltage reference generator.

In the bandgap voltage reference circuit 102 of FIG. 3, instead of setting, for example, L*n*lnK=25.8 to get the zero temperature coefficient (TC) for the bandgap reference of FIG. 1, the equation is set such that L*n*lnK=8. Therefore, $$V_{bgint}=8*25.6\text{ mV}+0.65=0.85\text{ volts at }27^\circ\text{ C.}$$

$$V_{bgint}=0.085\text{ mV}*(-40-27)*8-2.2\text{ mV}*(-40-27)+0.85=0.95\text{ V at }40^\circ\text{ C.}$$

While the temperature coefficient (TC) is not zero, the minimum power supply voltage may be slightly higher than 0.95 volts at cold temperature.

The voltage reference generator 100 further includes a differential sensing device 120 configured as an inverting amplifier. As shown in FIG. 3, the first CTAT signal $V_{bgint}$ is connected to the differential sensing device 120 and the second CTAT signal $V_{d2}$ is connected to a unity gain buffer 122 with the resultant signal, a buffered second CTAT signal $V_{d2_buf}$ connecting to the differential sensing device 120 to provide an acceptable input impedance to the differential sensing device 120. A reference signal $V_{bandgap}$ from a differential amplifier 128 is calculated as:

$$V_{bandgap} = V_{bgint} * (R1 + R2) * R4 / ((R3 + R4) * R1) - V_{d2} * R2 / R1$$

Values for resistors 130, 132, 134, 136 may be selected by $$\text{setting}(R1 + R2) * R4 / ((R3 + R4) * R1) = 1.82 \text{ and } R2 / R1 = 1.26.$$

$$\text{Thus, } V_{bandgap} = 1.82 * V_{bgint} - 1.26 * V_{d2}.$$

$$V_{bandgap} = 1.82 * 0.85 - 1.26 * 0.65 = 0.73\text{ V at }27^\circ\text{ C.}$$

$$\begin{aligned} \textit{Similarly, } V_{bandgap} &= 1.82 * V_{bgint} - V_{d2} * 1.26. \\ &= 1.82 * (L * n * \ln K * V_t + V_{d2}) - 1.26 * V_{d2} \\ &= 0.56 * V_{d2} + 1.82 * 8 * V_t \\ &= 0.56 * V_{d2} + 14.56 * V_t \end{aligned}$$

Since the $V_{d2}$ has a −2.2 mV/C temperature coefficient (TC) and Vt has a 0.085 mV/C temperature coefficient (TC), the $V_{bandgap}$ will have a 0.56*(−2.2 m)+14.56*0.085 m=0 temperature coefficient (TC).

Accordingly, the voltage reference generator 100 generates a reference signal $V_{bandgap}$ based upon two separate complementary-to-absolute-temperature (CTAT) signals, namely the first CTAT signal $V_{bgint}$ and the second CTAT signal $V_{d2}$.

Figure 4:
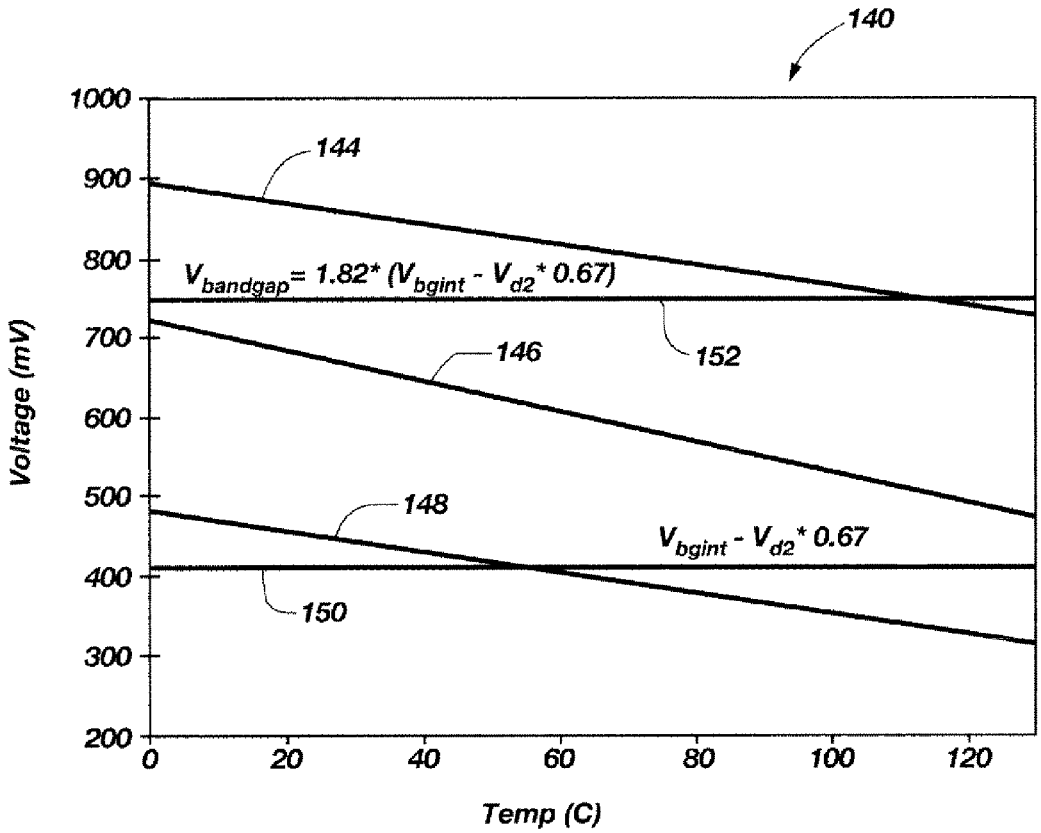
FIG. 4 is a plot diagram of various signals of the voltage reference generator of FIG. 3, in accordance with an embodiment of the present invention.

FIG. 4 is a plot diagram of various signals of the circuit of FIG. 3, in accordance with an embodiment of the present invention. A plot diagram 140 illustrates the various signals plotted over an operating range of temperatures and the resultant signal level voltages ranging from 200 V to 1000 mV. A $V_{bgint}$ plot 144 corresponds to a plot of the first CTAT signal $V_{bgint}$ (FIG. 3). The $V_{bgint}$ plot 144 illustrates a signal that varies with temperature in a complementary relationship characteristic of CTAT signals. Additionally, the first CTAT signal $V_{bgint}$ varies with temperature according to a first temperature coefficient (TC).

Similarly, a $V_{d2}$ plot 146 corresponds to a plot of the second CTAT signal $V_{d2}$ (FIG. 3). The $V_{d2}$ plot 146 illustrates a signal that varies with temperature in a complementary relationship characteristic of CTAT signals. Additionally, the second CTAT signal $V_{d2}$ varies with temperature according to a second temperature coefficient (TC). From calculations, one or both of the first and second temperature coefficients may be adjusted to approximate the other temperature coefficient resulting with slopes of both signal plots 144 and 146 approximately equal. In FIG. 4, a ratio of 0.67 when multiplied with the $V_{d2}$ plot 146 corresponding to the plot of the second CTAT signal $V_{d2}$ (FIG. 3), results in a $V_{d2}$*0.67 plot 148 having a slope (e.g., temperature coefficient (TC)) of an approximately equal magnitude with the $V_{bgint}$ plot 144. A difference plot 150 is a plot of $V_{bgint}-V_{d2}*0.67$ resulting in a plot with approximately a zero temperature coefficient (TC) across the illustrated operating range.

Once a zero temperature coefficient (TC) signal for a specific operating temperature range is generated, the signal may be shifted via a differential sensing device 120 (FIG. 3) to a desired level. In the present example, a reference signal of approximately 750 mV is desirable for a memory device operating with voltage levels of approximately 1.0 V. FIG. 4 illustrates a $V_{bandgap}$ plot 152 corresponding to one example of a desired reference level of approximately 750 mV.

Figure 2:
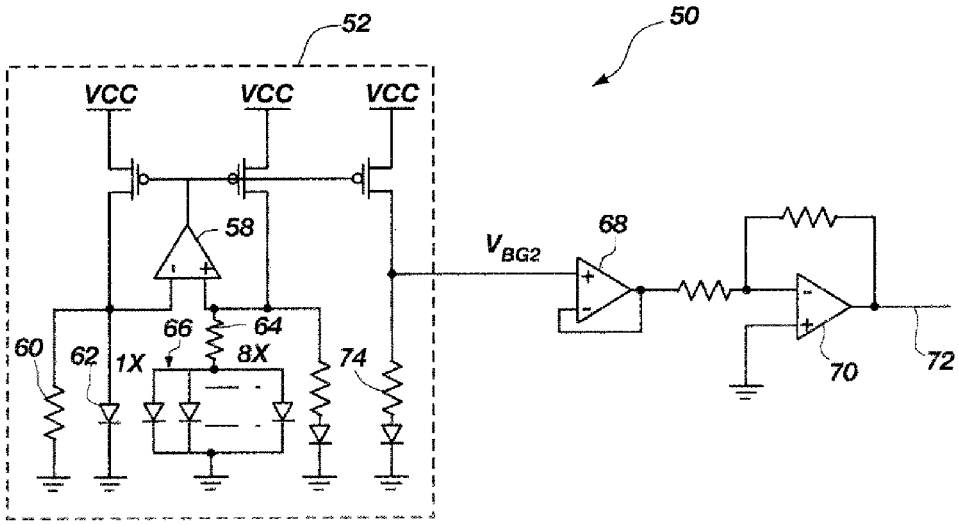
FIG. 2 (PRIOR ART)
FIG. 2 is a circuit diagram of another conventional voltage reference generator.
Figure 5A:
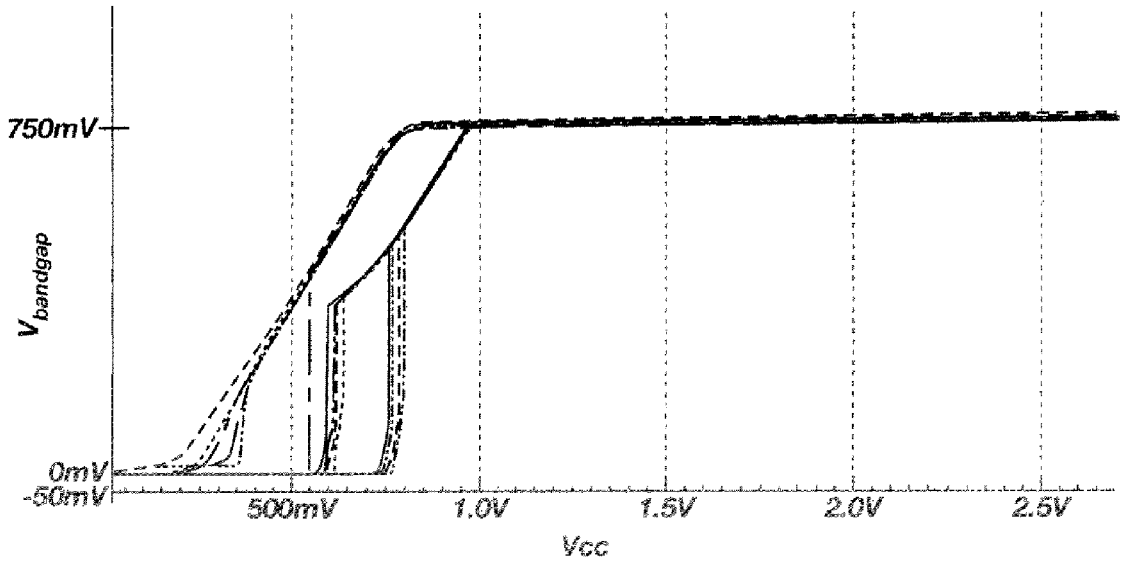
FIG. 5A is a plot diagram illustrating performance of the voltage reference generator of FIG. 3 across process, voltage, and temperature variations, according to an embodiment of the present invention.
Figure 5B:
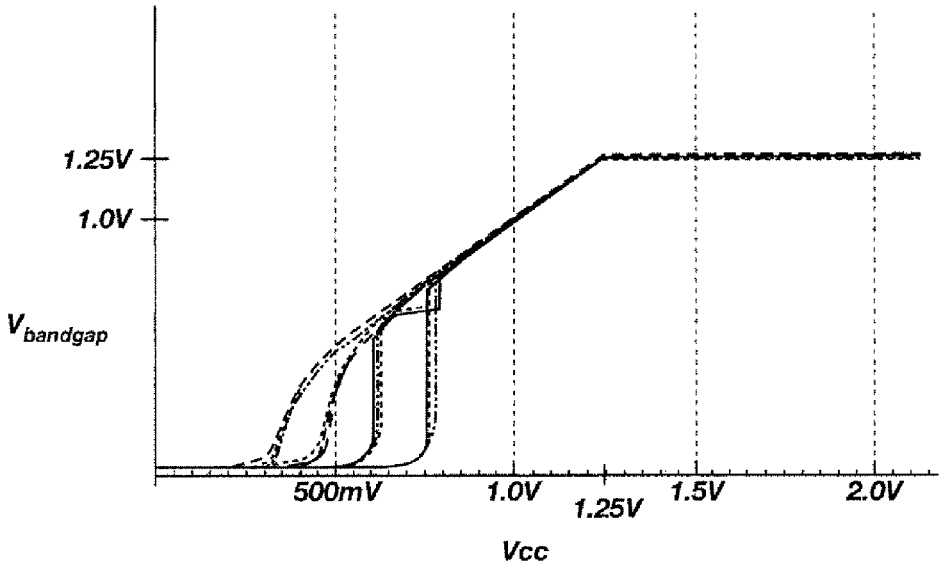
FIGS. 5B and 5C are plot diagrams illustrating performance of the conventional voltage reference generators illustrated in FIGS. 1 and 2, respectively.
Figure 5C:
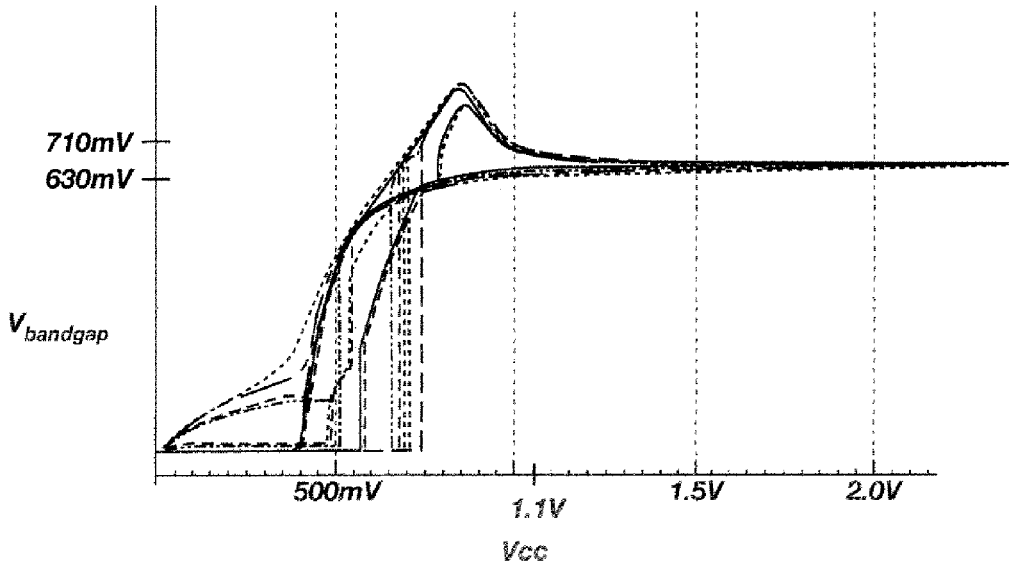

FIGS. 5A, 5B, and 5C illustrate simulated outputs across variations in process, voltage, and temperature (PVT) during operation of voltage reference generators 100, 10, and 50, respectively. As illustrated in FIG. 5A, voltage reference generator 100 has a zero temperature coefficient and may generate a reference signal $V_{bandgap}$ of approximately 750 mV at a supply voltage Vcc as low as 1.0 volt. As illustrated in FIG. 5B, voltage reference generator 10 has a zero temperature coefficient and generates signal $V_{BG1}$ of approximately 1.25 volts at a supply voltage Vcc of approximately 1.25 volts or greater. Furthermore, as illustrated in FIG. 5C, voltage reference generator 50 has a zero temperature coefficient and generates signal $V_{BG2}$ of approximately 650 mV at a supply voltage Vcc of approximately 1.1 volts or greater. As a result, voltage reference generator 100 provides a relatively stable reference signal at a lower supply voltage than the conventional reference generators illustrated in FIGS. 1 and 2.

Figure 6:
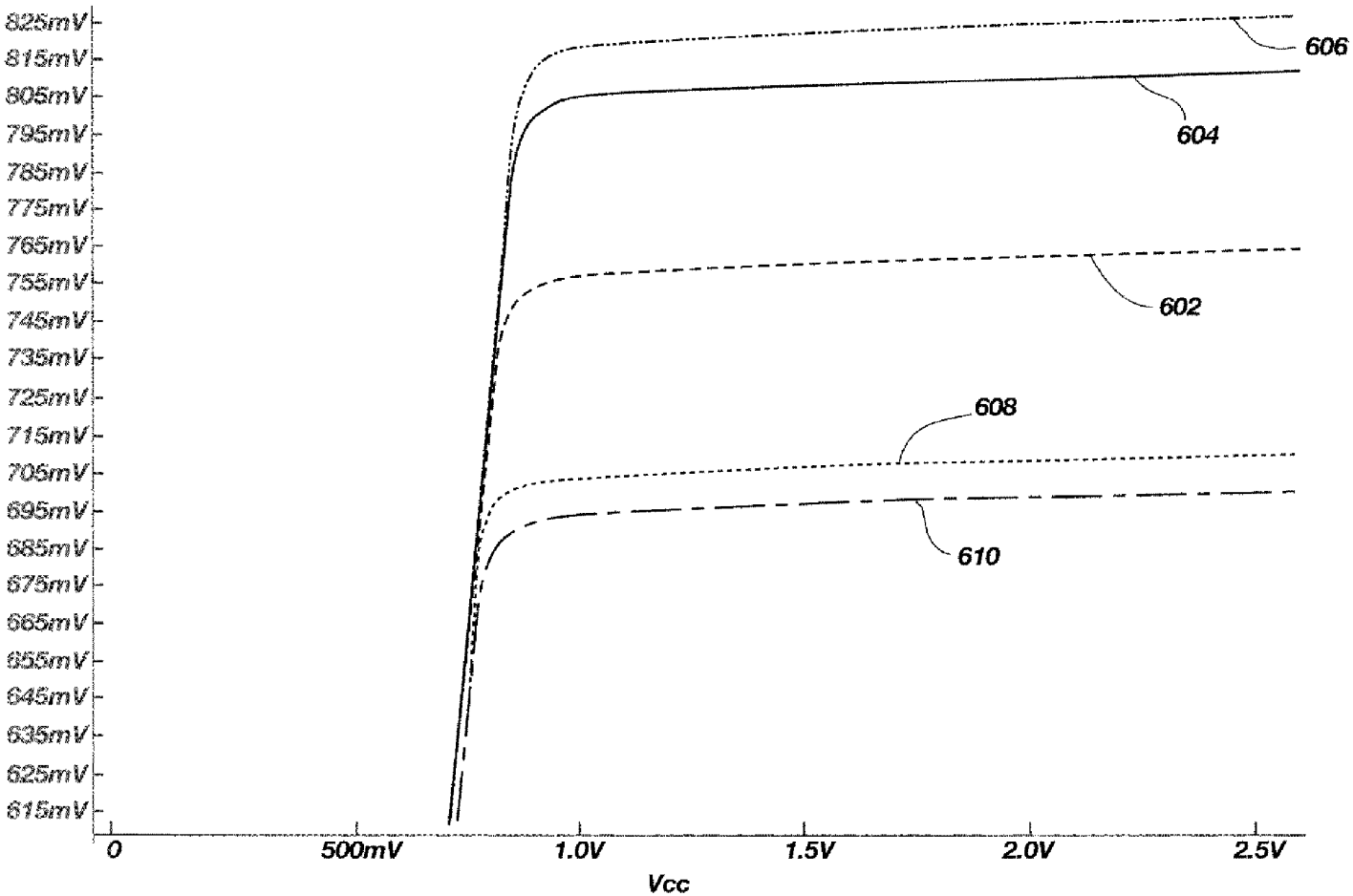
FIG. 6 is a plot diagram illustrating performance of the voltage reference generator of FIG. 3 during a voltage offset, in accordance with an embodiment of the present invention.

With reference again to FIG. 3, a non-inverting input of unity gain buffer 122 is operably coupled to signal $V_{d2}$ and, as a result, a voltage of signal $V_{d2}$ is used as an internal voltage level for voltage reference generator 100. Using the voltage of signal $V_{d2}$ as an internal voltage level, as opposed to the voltage of signal $V_{d1}$, may decrease the variation of reference signal $V_{bandgap}$ during a voltage offset experienced by differential amplifier 108. More specifically, if a positive offset exists at op amp 108 (i.e., $V_{d2}=V_{d1}$+Voffset), the voltage of signals $V_{d2}$, $V_{bgint}$, and $V_{bandgap}$ should each increase, and a voltage difference between the voltage of signal $V_{bgint}$ and a voltage of $0.67*V_{d2}$ should be less than a voltage difference between the voltage of signal $V_{bgint}$ and a voltage of $0.67*V_{d1}$ ($V_{bgint}-0.67*V_{d2}<V_{bgint}-0.67*V_{dt}$). Referring to FIG. 6, curve 602 is a plot of reference signal $V_{bandgap}$ wherein differential amplifier 108 does not include an offset ($V_{d2}=V_{d1}$). Curves 606 and 604 are respective plots of reference signal $V_{bandgap}$ during a 10 mV positive offset at op amp 108 using the voltage of signal $V_{d1}$ and the voltage of signal $V_{d2}$ as an internal voltage level. As illustrated in FIG. 6, the voltage difference between curve 606 (using the voltage of signal $V_{d1}$) and curve 602 is greater than the voltage difference between curve 604 (using the voltage of signal $V_{d2}$) and curve 602. Therefore, using the voltage of signal $V_{d2}$ as an internal voltage level, as opposed to the voltage of signal $V_{d1}$, decreases the amount of deviation of reference signal $V_{bandgap}$ during a positive offset at op amp 108.

Similarly, if a negative offset exists at op amp 108 (i.e., $V_{d2}=V_{d1}-V_{offset}$), the voltages of signals $V_{d2}$, $V_{bgint}$, and $V_{bandgap}$ should each decrease, and a voltage difference between signal $V_{bgint}$ and a voltage of $0.67*V_{d2}$ should be greater than a voltage difference between signal $V_{bgint}$ and a voltage of $0.67*V_{d1}$ ($V_{bgint}-0.67*V_{d2}>V_{bgint}-0.67*V_{d1}$). With reference again to FIG. 6, curves 610 and 608 are plots of reference signal $V_{bandgap}$ during a 10 mV negative offset at op amp 108 using internal voltages levels at signals $V_{d1}$ and $V_{d2}$, respectively. As illustrated in FIG. 6, the voltage difference between curve 610 (using the voltage of signal $V_{d1}$) and curve 602 is greater than the voltage difference between curve 608 (using the voltage of signal $V_{d2}$) and curve 602. Therefore, using the voltage of signal $V_{d2}$ as an internal voltage level, as opposed to the voltage of signal $V_{d1}$, decreases the amount of deviation of reference signal $V_{bandgap}$ during a negative offset at op amp 108.

Figure 7:
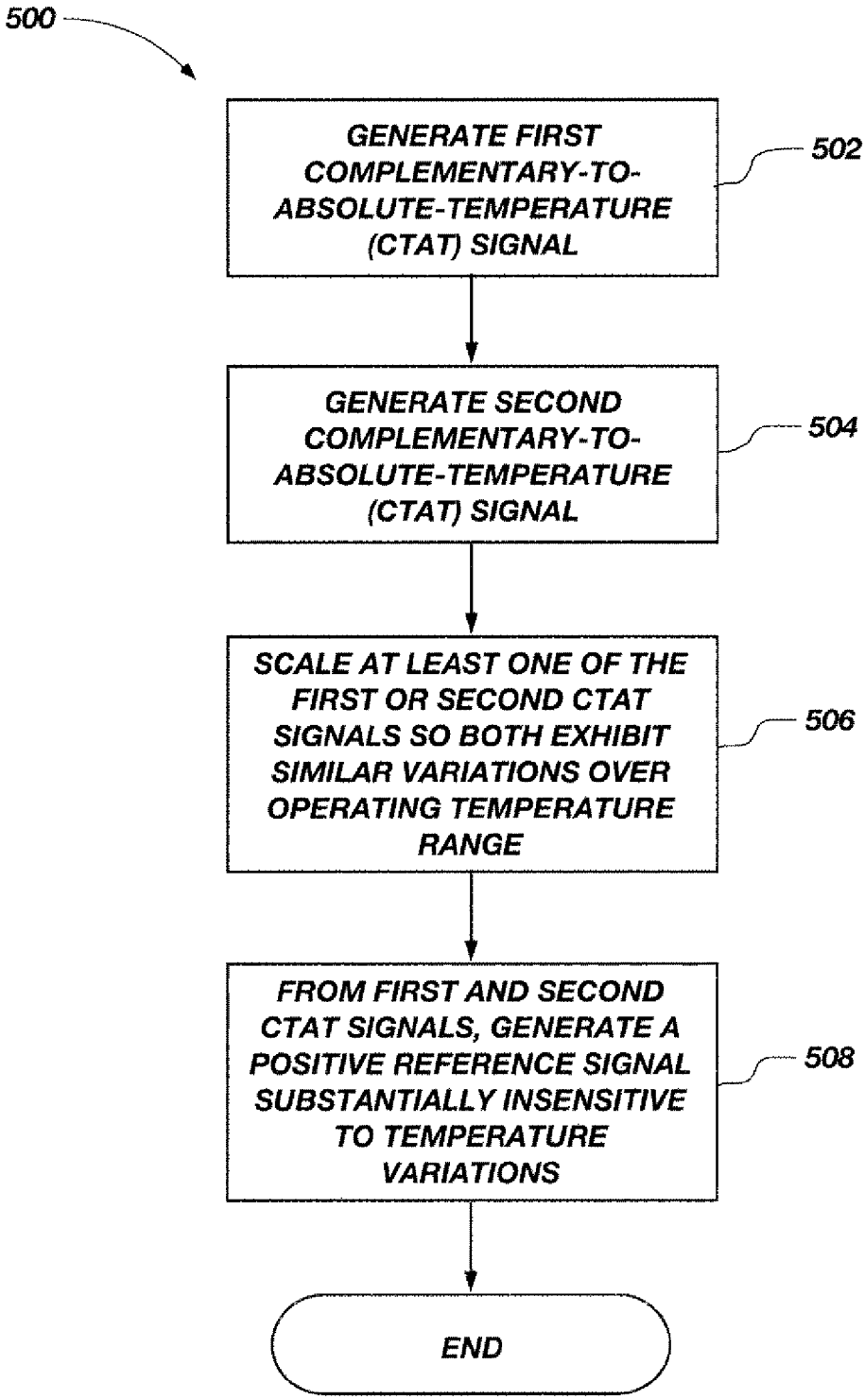
FIG. 7 is a flowchart of a method for generating a reference signal, in accordance with an embodiment of the present invention.

FIG. 7 is a flowchart for generating a reference signal from first and second complementary-to-absolute-temperature (CTAT) signals, in accordance with an embodiment of the present invention. A method 500 for generating a reference signal includes generating 502 a first complementary-to-absolute-temperature (CTAT) signal. The first CTAT signal may be generated from a bandgap voltage reference circuit 102 such as previously described with reference to FIG. 3. The first CTAT signal may be generated as a voltage signal that is generated as an output of a bandgap voltage reference circuit but exhibits an inversely varying relationship to temperature.

The method for generating a reference signal further includes generating 504 a second complementary-to-absolute-temperature (CTAT) signal. The second CTAT signal may also be generated from a bandgap voltage reference circuit 102 such as previously described with reference to FIG. 3. The second CTAT signal exhibits an inversely varying relationship to temperature and is nonorthogonal with the first CTAT signal. The second CTAT signal may be further buffered such as through a unity gain buffer, for example, to provide a compatible output impedance for further coupling with other circuit.

The method for generating a reference signal yet further includes scaling 506 at least one of the first and second CTAT signals such that both first and second CTAT signals exhibit a substantially equivalent variation to temperature over a desired operating temperature range. The method further includes generating 508 a positive reference signal substantially insensitive to temperature variations over an operating temperature range from differentially sensing the first and second CTAT signals.

Figure 8:
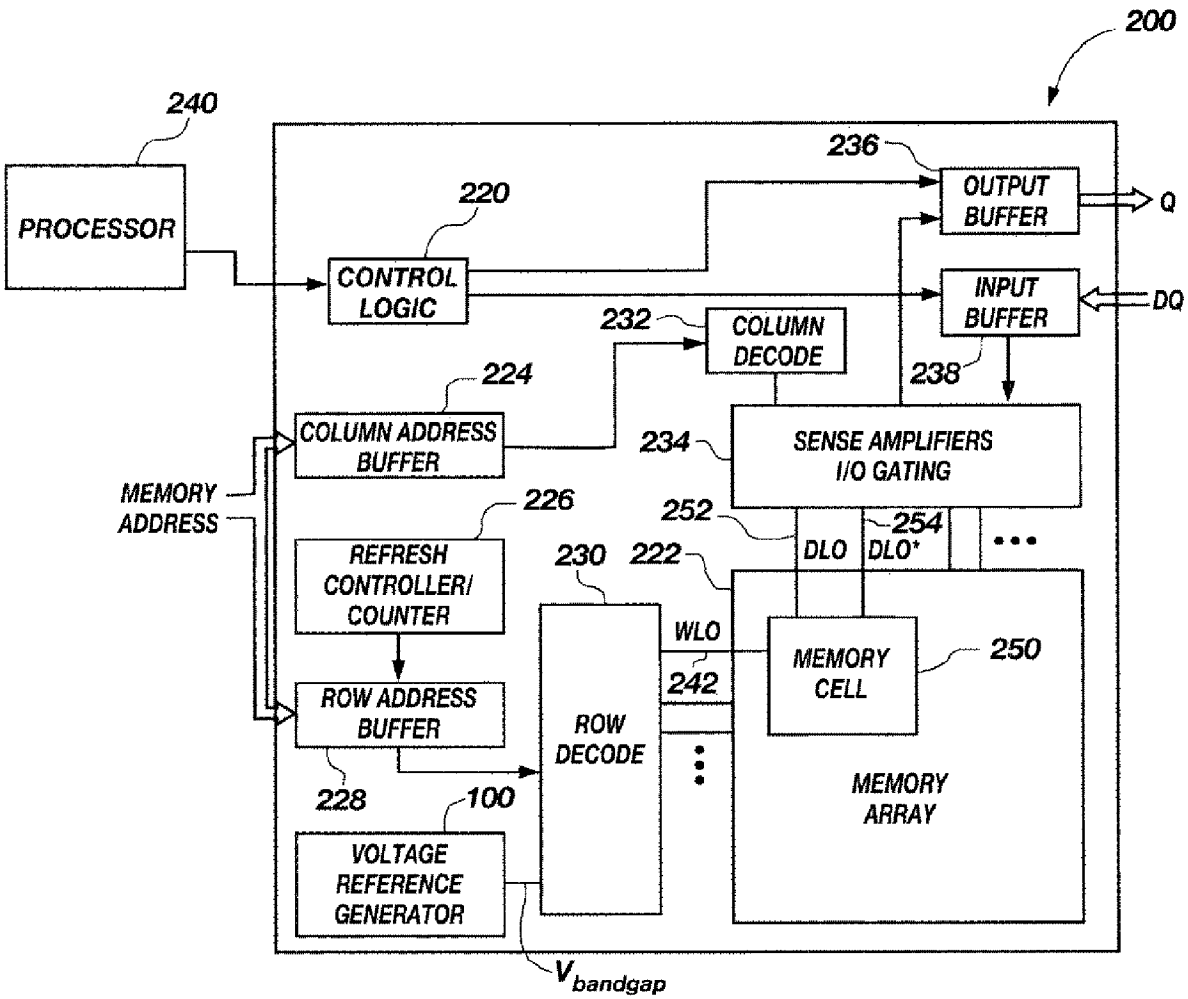
FIG. 8 is a block diagram of a memory device including a voltage reference generator, according to an embodiment of the present invention.

FIG. 8 is a block diagram of a memory device including a voltage reference generator, in accordance with another embodiment of the present invention. A DRAM memory device 200 includes control logic circuit 220 to control read, write, erase and perform other memory operations. A column address buffer 224 and a row address buffer 228 are adapted to receive memory address requests. A refresh controller/counter 226 is coupled to the row address buffer 228 to control the refresh of the memory array 222. A row decode circuit 230 is coupled between the row address buffer 228 and the memory array 222. A column decode circuit 232 is coupled to the column address buffer 224. Sense amplifiers-I/O gating circuit 234 is coupled between the column decode circuit 232 and the memory array 222. The DRAM memory device 200 is also illustrated as having an output buffer 236 and an input buffer 238. An external processor 240 is coupled to the control logic circuit 220 of the DRAM memory device 200 to provide external commands.

A voltage reference generator 100 generates a reference signal $V_{bandgap}$ for coupling with the word lines 242 when inactive, in accordance with the one or more embodiments of the present invention. A memory cell 250 of the memory array 222 is shown in FIG. 8 to illustrate how associated memory cells are implemented in the present invention. The word lines WL 242 are coupled to the pass or access gates of the memory cell 250. When the word lines WL 242 are inactive, the leakage of the charge stored in memory cell 250 is reduced by coupling the inactive word lines WL 242 to the reference signal $V_{bandgap}$ maintained at a potential above ground. When the memory cell 250 is read, the retained charge is discharged to digit lines DL0 252 and DL0* 254. Digit line DL0 252 and digit line DL0* 254 are coupled to a sense amplifiers-I/O gating circuit 234.

Figure 9:
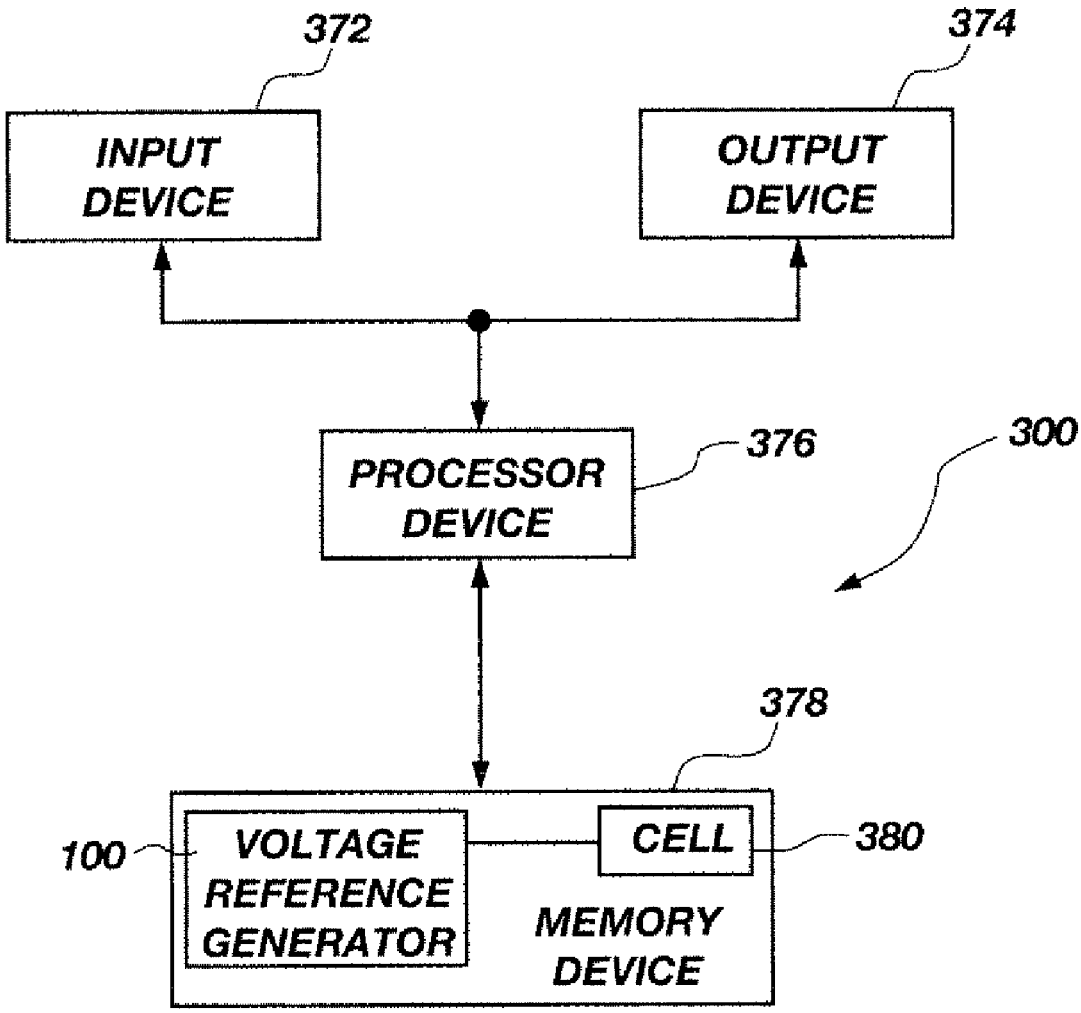
FIG. 9 is a block diagram of an electronic system including a memory device further including a voltage reference generator, in accordance with an embodiment of the present invention.

FIG. 9 is a block diagram of an electronic system including a memory device, in accordance with a further embodiment of the present invention. The electronic system 300 includes an input device 372, an output device 374, and a memory device 378, all coupled to a processor device 376. The memory device 378 incorporates at least one voltage reference generator 100 of one or more of the preceding embodiments of the present invention for coupling with an inactive word line of at least one memory cell 380. The electronic system 3 may comprise, by way of nonlimiting example, a personal computer, server, controller, cellular telephone, personal digital assistant, digital camera or other system incorporating the aforementioned components.

Specific embodiments have been shown by way of nonlimiting example in the drawings and have been described in detail herein; however, the various embodiments may be susceptible to various modifications and alternative forms. It should be understood that the invention is not limited to the particular forms disclosed. Rather, the invention encompasses all modifications, equivalents, and alternatives falling within the scope of the following appended claims and their legal equivalents.

What is claimed is:

1. A voltage reference generator, comprising:

a bandgap voltage reference circuit including:

a first divider network configured to generate a first divider network voltage;

a second divider network including a diode array and configured to generate a second divider network voltage, the second divider voltage being a first complementary-to-absolute-temperature (CTAT) signal; and a differential amplifier operably coupled with the first divider network and the second divider network, and configured to generate a second CTAT signal in response to receiving the first divider network voltage and the second divider network voltage as inputs; and a differential sensing device operably coupled with the bandgap voltage reference circuit, the differential sensing device including the first CTAT signal operably coupled with an inverting input of the differential sensing device, and the second CTAT signal operably coupled with a non-inverting input of the differential sensing device, wherein the differential sensing device is furthered configured to generate a positive reference signal substantially insensitive to temperature variations over an operating temperature range in response to the first CTAT signal and the second CTAT signal, wherein the positive reference signal is relatively closer, during an offset condition of the first divider network voltage and the second divider network voltage, to an ideal output of the positive reference signal than is a voltage difference between the second CTAT signal and the first divider network voltage, the ideal output being the positive reference signal when the first divider network voltage and the second divider network voltage are equal.

2. The voltage reference generator of claim 1, wherein at least one of the first CTAT signal and the second CTAT signal are adapted to be sensitive to temperature variations over the operating temperature range.

3. The voltage reference generator of claim 1, wherein the differential sensing device is further configured to scale at least one of the first CTAT signal and the second CTAT signal to cause each of the first CTAT signal and the second CTAT signal to exhibit substantially equivalent variations over the operating temperature range, and wherein the positive reference signal is relatively closer, during the offset condition to the ideal output than is a voltage difference between the second CTAT signal and the first divider network voltage when similarly scaled.

4. The voltage reference generator of claim 1, further comprising a unity gain buffer operably coupled between the bandgap voltage reference circuit and the differential sensing device, the unity gain buffer configured to condition at least one of the first CTAT signal and the second CTAT signal for coupling with the differential sensing device.

5. The voltage reference generator of claim 1, wherein at least one of the first CTAT signal and the second CTAT signal comprises a nonzero temperature coefficient.

6. The voltage reference generator of claim 1, wherein the positive reference signal is approximately 750 mV over the operating temperature range.

7. A voltage reference generator, comprising:

a bandgap voltage reference circuit including:

a first signal generated from a diode array of a first divider network;

a second signal generated from a second divider network; and a third signal generated from an output of a differential amplifier in response to the first signal and the second signal being input to the differential amplifier; and a differential sensing device with an inverting input configured to receive the first signal and a non-inverting input configured to receive the third signal, the differential sensing device configured to generate a reference signal from a difference of the third signal and the first signal, the reference signal being substantially insensitive to temperature variations over an operating temperature range, wherein the reference signal is relatively closer to an ideal reference signal than is a difference in the third signal and the second signal when the first signal and the second signal are unequal, the ideal reference signal being a voltage level for the reference signal when the first signal and the second signal are equal.

8. The voltage reference generator of claim 7, further comprising a unity gain buffer operably coupled between the first signal and the differential sensing device.

9. The voltage reference generator of claim 7, wherein the first divider network comprises a first resistive element operably coupled in series between a second resistive element and the diode array, wherein the first signal is a voltage at a node between the first resistive element and the second resistive element.

10. The voltage reference generator of claim 7, wherein the second divider network comprises a third resistive element operably coupled in series with a diode element, wherein the second signal is a voltage at a node between the third resistive element and the diode element.

11. The voltage reference generator of claim 7, wherein the bandgap voltage reference circuit is configured to use the first signal as an internal voltage level.

12. The voltage reference generator of claim 7, wherein the reference signal comprises a positive reference signal over the operating temperature range.

13. The voltage reference generator of claim 7, wherein each of the first signal and the third signal is configured to exhibit a decrease in voltage during an increase in an operating temperature.

14. The voltage reference generator of claim 7, wherein the differential sensing device comprises an inverting amplifier including the inverting input and the non-inverting input.

15. A method for generating a reference signal, comprising:

generating a first voltage at a first node operably coupled between a first resistive element and at least one diode;

generating a second voltage at a second node operably coupled between a second resistive element and a diode array to generate a first complementary-to-absolute-temperature (CTAT) signal;

generating a second CTAT signal in response to receiving the first voltage and the second voltage as inputs to a differential amplifier;

inputting the first CTAT signal to an inverting input of a sensing device;

inputting the second CTAT signal to a non-inverting input of the sensing device; and subtracting the first CTAT signal from the second CTAT signal to generate a positive reference signal substantially insensitive to temperature variations over an operating temperature range, wherein the positive reference signal has a voltage level that, during an offset of the first voltage and the second voltage, is relatively closer to an ideal output than is a difference between the second CTAT signal and the second voltage, the ideal output being the positive reference signal generated when the first voltage and the second voltage are equal.

16. The method of claim 15, wherein generating the first CTAT signal and the second CTAT signal comprises generating at least one signal that is adapted to be sensitive to temperature variations over the operating temperature range.

17. The method of claim 15, further comprising scaling at least one of the first CTAT signal and the second CTAT signal so each of the first CTAT signal and the second CTAT signal exhibit substantially equivalent variations over the operating temperature range, wherein the positive reference signal has a voltage level that, during the offset of the first voltage and the second voltage, is relatively closer to the ideal output than is a difference between the second CTAT signal and the second voltage that are similarly scaled.

18. The method of claim 15, further comprising buffering at least one of the first CTAT signal and the second CTAT signal prior to inputting to the sensing device.

19. The method of claim 15, wherein at least one of the first CTAT signal and the second CTAT signal includes a nonzero temperature coefficient.

20. A memory device, comprising:

a memory array; and a voltage reference generator operably associated with the memory array, including:

a bandgap voltage reference circuit including a first signal generated by a first divider network having a diode array, a second signal generated by a second divider network, and a third signal generated by a differential amplifier responsive to receiving the first signal and the second signal, wherein the first signal and the third signal are complementary-to-absolute temperature (CTAT) signals; and a differential sensing device configured to generate a reference signal above a ground potential responsive to sensing the first signal and the third signal, wherein the reference signal is substantially insensitive to temperature variations over an operating temperature range, wherein the reference signal has a voltage that is closer to an ideal reference signal relative to a voltage difference between the third signal and the second signal when there exists an offset voltage between the first signal and the second signal, the ideal reference signal being the reference signal that is generated when the first signal and the second signal are equal.

21. The memory device of claim 20, wherein the reference signal is at a voltage level of approximately 750 mV over an operating temperature range of the voltage reference generator.

22. An electronic system, comprising:

at least one processor;

at least one memory device; and at least one voltage reference generator operably associated with the at least one memory device and comprising:

a bandgap voltage reference circuit including a first signal and a second signal, the first signal generated at a node coupled to a diode array and the second signal generated from a differential amplifier configured to receive the first signal and a third signal as inputs, wherein each of the first signal and the second signal is configured to exhibit a decrease in voltage during an increase in operating temperature;

a differential sensing device configured to generate a positive reference signal substantially insensitive to temperature variations over an operating temperature range from sensing the first signal and the second signal, wherein, during an offset between the first signal and the third signal, a difference between a voltage of the positive reference signal and its ideal voltage is relatively smaller than is a difference between voltages of the second signal and the third signal, the ideal voltage of the positive reference signal being generated when the first and third signal have equal voltages; and a unity gain buffer configured to receive the first signal and output a buffered signal to an inverting input of the differential sensing device.

23. The voltage reference generator of claim 1, wherein the offset condition includes the first divider network voltage having a voltage that is greater than the second divider network voltage.

24. The voltage reference generator of claim 1, wherein the offset condition includes the first divider network voltage having a voltage that is less than the second divider network voltage.

25. The method of claim 15, wherein the generating the second CTAT signal and generating the positive reference signal, includes:

increasing voltages of the second CTAT signal and the positive reference signal when the offset includes the first voltage being less than the second voltage; and decreasing the voltages of the second CTAT signal and the positive reference signal when the offset includes the first voltage being greater than the second voltage.

* * * * *

UNITED STATES PATENT AND TRADEMARK OFFICE

CERTIFICATE OF CORRECTION

PATENT NO. : 7,994,849 B2
APPLICATION NO. : 12/059357
DATED : August 9, 2011
INVENTOR(S) : Dong Pan It is certified that error appears in the above-identified patent and that said Letters Patent is hereby corrected as shown below:

In the Claims:

In column 9, line 3, in Claim 3, delete "condition" and insert -- condition, --, therefor.

Signed and Sealed this
Fourteenth Day of May, 2013

Teresa Stanek Rea
*Acting Director of the United States Patent and Trademark Office*